US005901474A

United States Patent [19]

Anderson

[11] Patent Number: 5,901,474

[45] Date of Patent: May 11, 1999

[54] SPIKELESS GOLF CLEAT

[76] Inventor: Scott Anderson, P.O. Box 171, Lake Geneva, Wis. 53147

[21] Appl. No.: 09/022,777

[22] Filed: Feb. 12, 1998

[51] Int. Cl.[6] ..... A43C 15/02; A43C 15/16

[52] U.S. Cl. ..... 36/134; 36/67 D

[58] Field of Search ..... 36/134, 67 R, 36/67 D, 67 A, 59 A, 59 C

[56] References Cited

U.S. PATENT DOCUMENTS

| | | | |
|---|---|---|---|
| 1,618,881 | 2/1927 | Junker | 36/67 D |
| 3,267,593 | 8/1966 | Turner | 36/67 D |
| 3,532,098 | 10/1970 | Rodenberger | 36/67 D |
| 3,731,406 | 5/1973 | Young | 36/67 D |
| 4,492,047 | 1/1985 | Arff | 36/134 |
| 4,578,883 | 4/1986 | Dassler | 36/59 C |
| 4,653,206 | 3/1987 | Tanel | 36/59 C |
| 4,698,923 | 10/1987 | Arff | 36/134 |
| 5,617,653 | 4/1997 | Walker et al. | 36/134 |

*Primary Examiner*—M. D. Patterson

*Attorney, Agent, or Firm*—Jansson, Shupe, Bridge & Munger, Ltd.

[57] ABSTRACT

An improved cleat structure for mounting a cleat onto a shoe wherein the cleat structure is comprised of a mounting base having integral connector and head portions wherein the connector portion is attached to the sole of the shoe and a ground-contact member is removably engaged with the head portion of the mounting base.

7 Claims, 5 Drawing Sheets

SPIKELESS GOLF CLEAT

FIELD OF THE INVENTION

This invention relates generally to spikes for athletic shoes and, more particularly, to a spikeless cleat and connection base for golf shoes.

BACKGROUND OF THE INVENTION

Spikes have been used in the sport of golf for quite some time. The conventional spike used on the bottom of a golfer's shoe insured a stable base during the golfer's swing by preventing the feet from slipping. The primary design used for years was a single spike in the center of a pad, screwed into the bottom of a golf style shoe. Generally each shoe contained in excess of 10 spikes. The single pointed spikes protruded from the shoe approximately ¼".

The results of the traditional style spike was damage to the golf course greens. The spikes punctured the crown of the grass plants as the golfer walked across the greens. Each spike destroying at least one grass plant for each step the golfer would take on the greens.

When playing a particular golf hole, the average golfer takes approximately 40 steps on the green. Given that there are 10 spikes on each shoe and each spike destroys at least one grass plant per step, the number of grass plants destroyed on a given green is 800 (2×10×40). If you multiply this number by 18—the number of greens played in a single round of golf—it becomes clear that 14,400 grass plants are destroyed by a golfer during each round of golf. Assuming that 340 golfers play golf in a single day, nearly 5 million blades of grass are destroyed daily with the use of traditional, single golf spikes.

Because of the destruction of the playing surface, a new spike concept described as "Spikeless" gained acceptance in the sport of golf throughout the 1990's. These newly accepted spike designs generally do not have a center spike causing damage to the crown of the grass plants on the greens of a golf course. Instead the "Spikeless Design" has a gripping pattern which is typically symmetrical to the center of the spike. The new designs attach in the same way as the traditional golf spike by threading to the bottom of the shoe. This evolution in design has provided protection to the crown of the grass plant resulting in minor destruction to the golf greens thereby greatly enhancing the playing surface.

The new "Spikeless" designs do not grip the surface of the ground in the same manner as the traditional single spike design. Also, the spikeless design has a tendency to get plugged up. The newly accepted spikeless designs are fashioned to be symmetrical in order to provide an even resistance from any and all angles of applied force as the spikes are randomly threaded into the bottom of the golf shoe. This is the bases for improving the design further to a directional force spikeless concept.

There are several parts of a golf swing. One of the most important parts involves the transfer of weight within the swing itself. During the transfer of weight, if the golfer does not have sure footing he or she could slip resulting in an errant shot.

The transfers of weight that occur during a golf swing are made in a specific direction requiring a greater holding requirement by a golfer's shoe in a single directional plane verses a multidirectional plane. Therefore if the newly accepted "Spikeless" design could be enhanced to provide an non-damaging design with better holding forces and no increase in cost to the consumer it would be a great improvement to the sport of golf.

OBJECTS OF THE INVENTION

An object of the invention is to provide a new spikeless cleat structure that overcomes some of the problems and shortcomings of the prior art.

Another object of the invention is to provide a new spikeless cleat structure that provides greater resistance to movement in one direction than another.

Still another object of the invention is to provide a new spikeless cleat structure that is easy to replace.

Yet another object of the invention is to provide a new spikeless cleat structure that is more comfortable than the traditional metal spike. How these and other objects are accomplished will become apparent from the following descriptions and from the drawings.

SUMMARY OF THE INVENTION

This invention involves an improvement to a cleated shoe having a sole with a cleat structure secured to it. The improvement involves the cleat structure which comprises a mounting base having integral connector and head portions where the connector portion is attached to the sole and a ground-contact member is removably engaged with the head portion of the mounting base.

In one embodiment of the invention, the head portion of the mounting base has an inner edge and a central recess. Spaced around the inner edge are a plurality of male segments and intervening female cutaways. The ground-contact member in such embodiment, has an outer edge along which a plurality of fastening segments are positioned. The fastening segments include a cutaway first part that is dimensioned to receive the male segment, a recessed second part, and a ramped segment that is located between the first part and the second part.

In a specific version of such embodiment, the connector portion of the mounting base is threaded, the sole of the shoe has a plurality of threaded receiving holes and the connector portion of the mounting base is screwed into the receiving hole.

In still a more specific version of the embodiment, the ground-contact member has a first surface and at least one protrusion extends from the first surface. In such version, the protrusions are elongated and the shoe has a longitudinal axis. The ground-contact member is engaged with the head portion in such a manner that the protrusion(s) is/are oriented so that their elongations are parallel to the longitudinal axis of the shoe.

In such specific version, each of the protrusions has a first side that is substantially perpendicular to the first surface of the ground-contact member and a second side that forms an acute angle with the first side whereby a greater resistance to motion in one direction than the other is provided.

In a more preferred embodiment of the invention, the ground-contact member has a first surface and at least one protrusion extends from the first surface. In a specific version of such embodiment, the shoe has a longitudinal axis, the protrusion(s) are elongated and the ground-contact member is engaged with the head portion in such a manner that the protrusion(s) are oriented so that their elongations are parallel to the longitudinal axis of the shoe.

In still another version the preferred embodiment, each of the protrusions has a first side that is substantially perpendicular to the first surface of the ground-contact member and a second side that forms an acute angle with the first side so that a greater resistance to motion in one direction than the other is provided.

BRIEF DESCRIPTION OF THE DRAWINGS

FIG. 4(*b*) is a top view of the ground-contact member.

FIG. 4(*c*) is a side view of the ground-contact member.

FIG. 5(*b*) is a top view of the head portion of the mounting base of the improved cleat structure.

FIG. 7(*b*) is a cross-sectional view of the head portion of the mounting base with the ground-contact member inserted.

FIG. 7(*c*) is sectional view of the improved cleat structure on the line 3—3 in FIG. 3.

DETAILED DESCRIPTIONS OF THE PREFERRED EMBODIMENTS

The game of golf which has grown steadily in popularity over the years has recently experienced a boom in which many people including women and young children have taken up the sport. Such increase in popularity has led to an increase in the number of rounds of golf that are played annually on golf courses around the country. This increase in play has resulted in increased wear and tear on all portions of the golf course including the tee box, fairways and putting greens.

Figure 1:
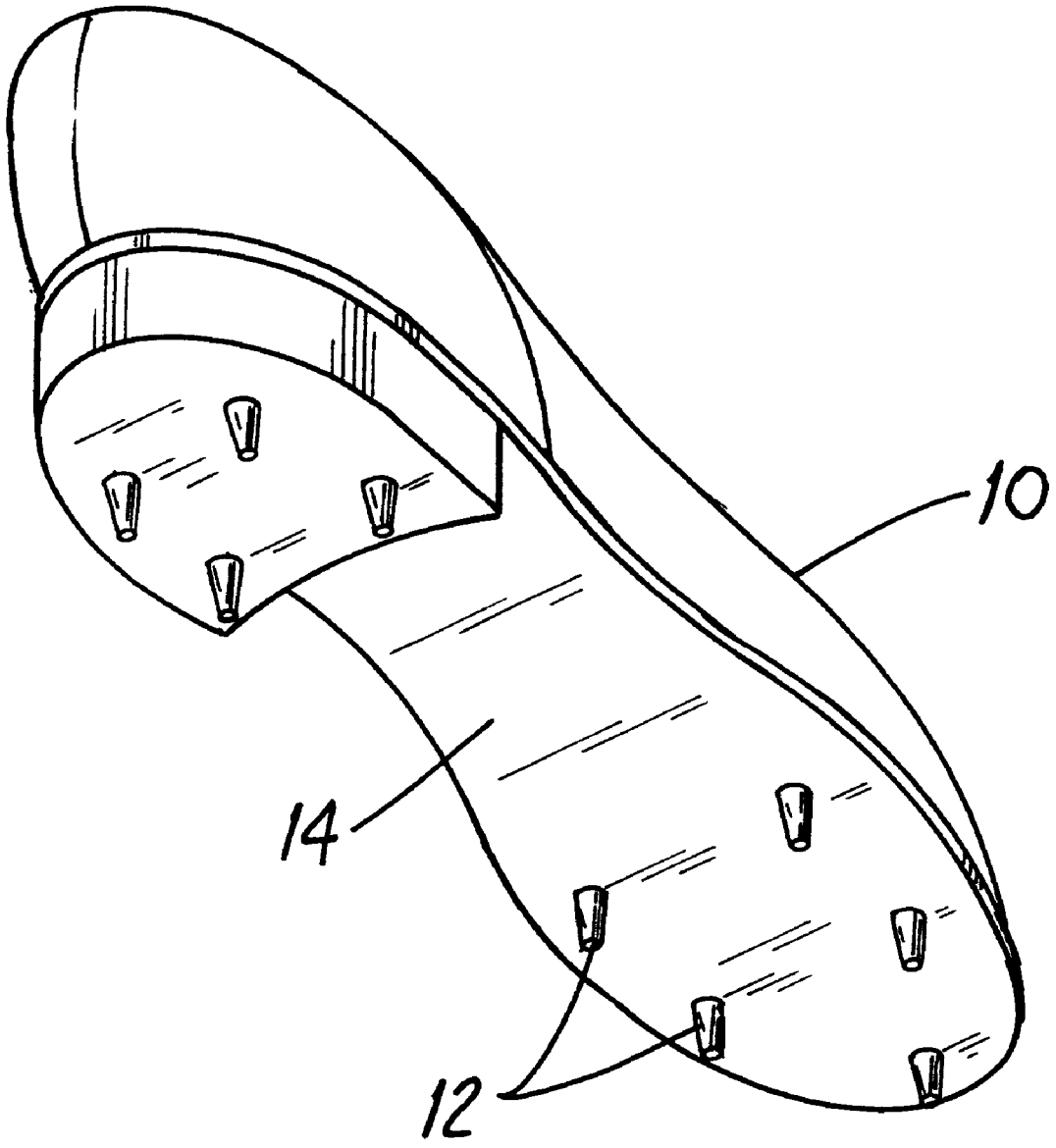
FIG. 1 is a perspective view of a golf shoe having the conventional metal golf spikes.

Golf is played wearing shoes, as shown in FIG. 1, that have a number of spikes protruding from the sole of the shoe. Such spikes, which traditionally have consisted of ¼ inch metal spikes, aid the golfer by helping to keep his lower body in place throughout the swing. In an attempt to reduce the wear and tear on the course, a new form of spikeless golf shoe has recently been introduced. This spikeless shoe differs from its predecessor in that the ground-contact portion of the shoe is made of a softer material such as plastic. While more comfortable to wear, a common complaint associated with the newer style golf spike is that it does provide the same degree of stability as the traditional metal spike. With the new spikeless shoe, one's foot may have a tendency to slide during the swing. Such movement is unacceptable because it causes a golfer to lose his balance thus altering the golf shot.

Figure 3:
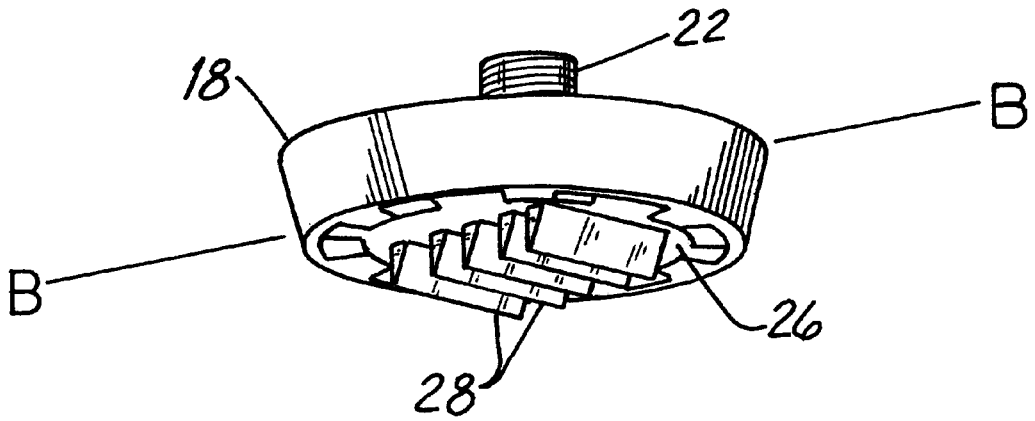
FIG. 3 is a perspective view of the improved cleat structure.
Figure 2:
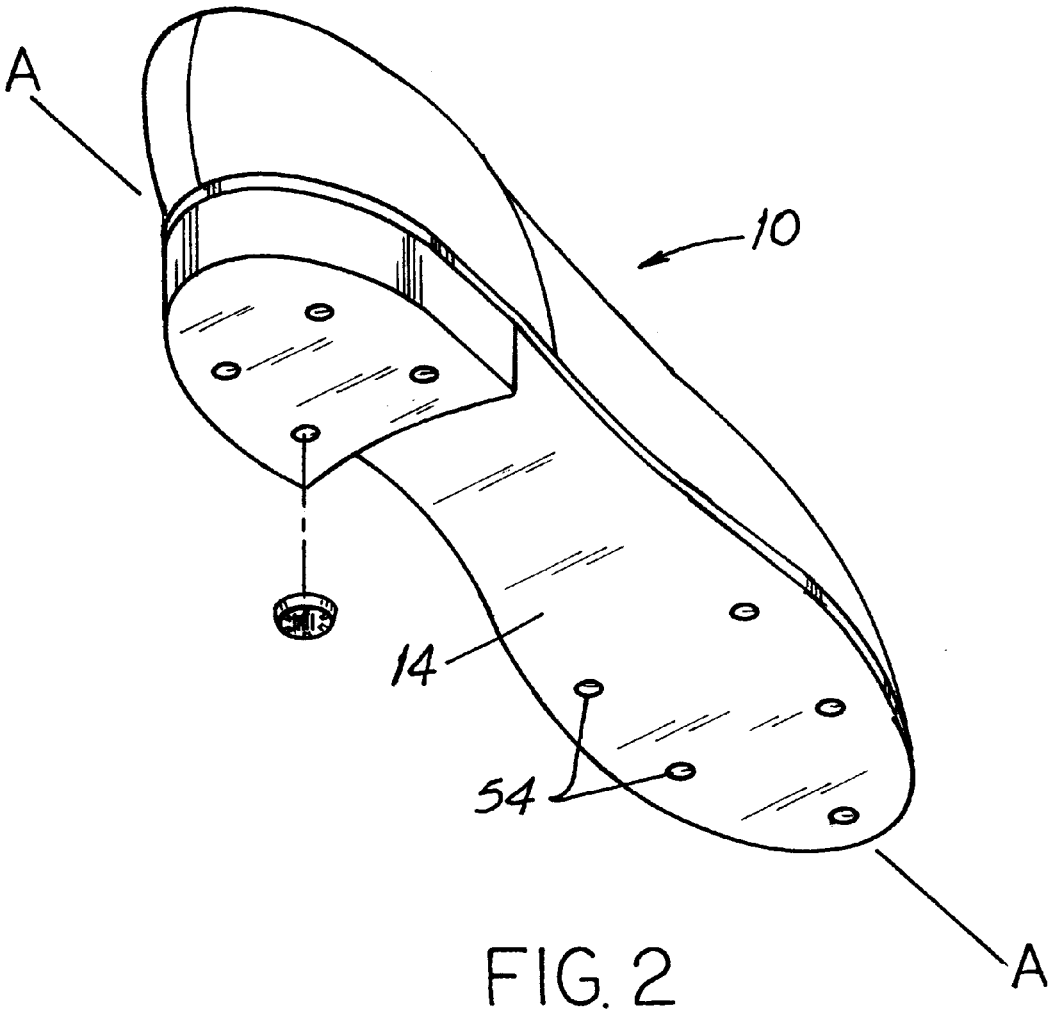
FIG. 2 is a perspective view of the improved cleat structure and of a shoe having a plurality of threaded receiving holes.
Figure 7A:
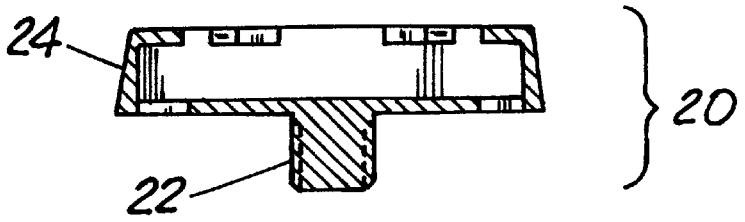
FIG. 7(*a*) is a cross-sectional view of the mounting base.
Figure 7B:
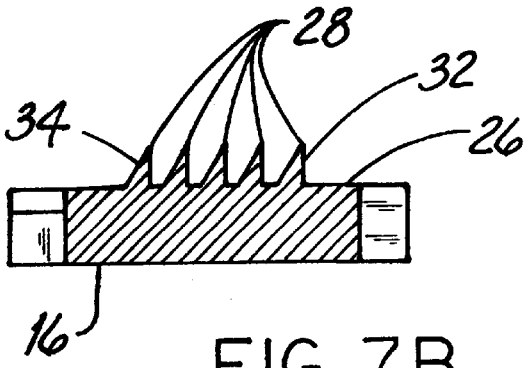
Figure 7C:
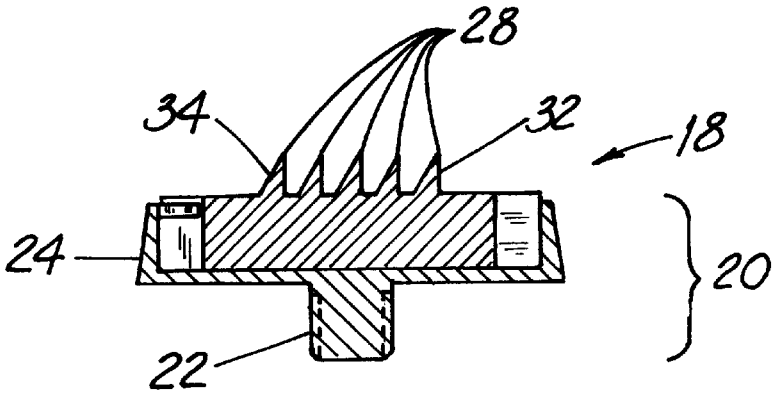

This invention involves an improvement to a cleated shoe, in particular a golf shoe 10, as shown in FIG. 2, that has a sole 14 with a cleat structure 18 secured to it. The improvement involves the cleat structure 18, as shown in FIG. 3 and FIGS. 7(*a*)–7(*c*), which comprises a mounting base 20 having integral connector 22 and head portions 24 where the connector portion 22 is attached to the sole 14 and a ground-contact member 16 is removably engaged with the head portion 24 of the mounting base 20.

Although other materials such as metals including MIM and carbon fiber may be used, the integral connector 22 and head portion 24 is normally made of plastic while the ground-contact member 16 is constructed of plastic or similar moldable soft material.

Figure 4A:
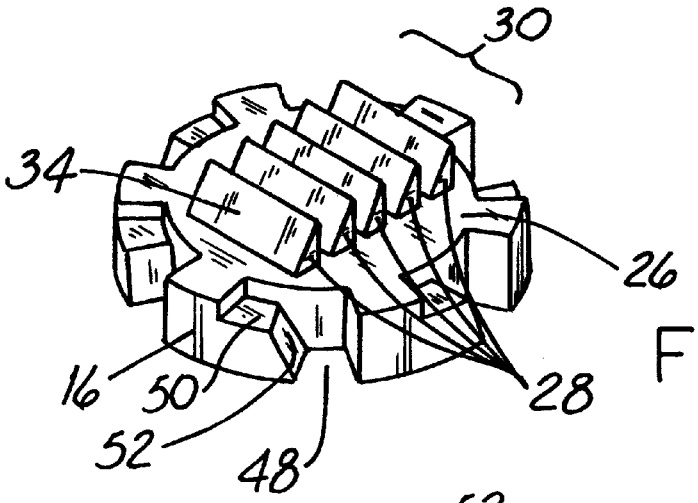
FIG. 4(*a*) is a perspective view of the ground-contact portion of the improved cleat structure showing elongated protrusions.
Figure 4B:
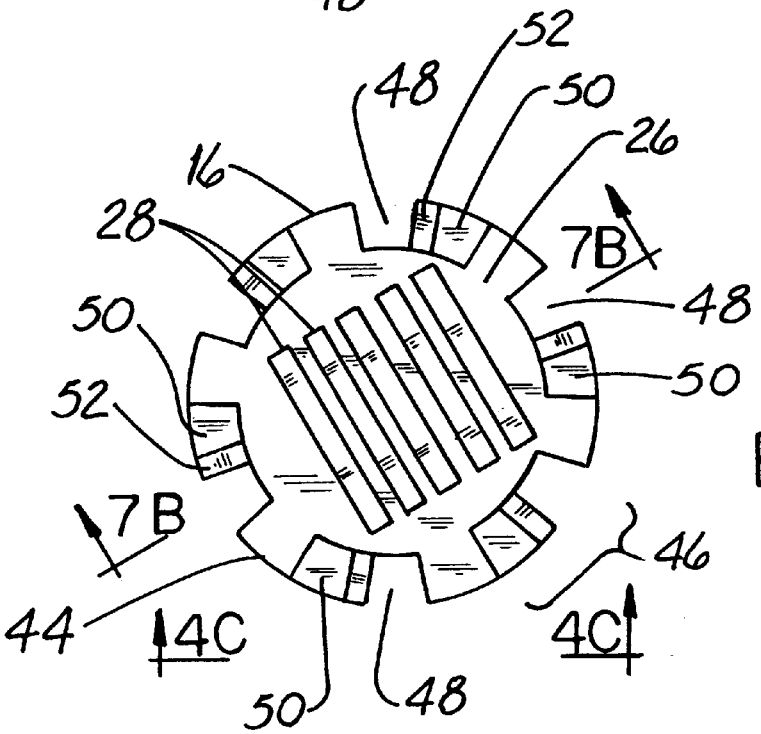
Figure 4C:
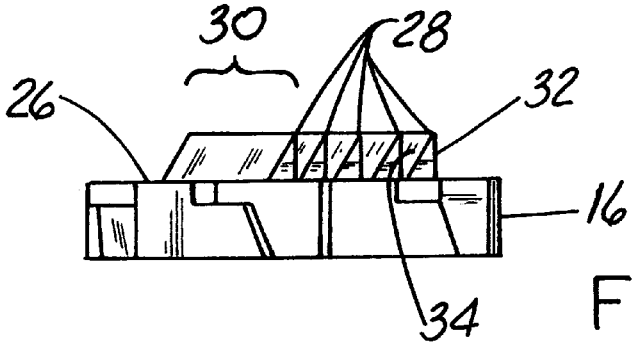

In one embodiment of the invention, the ground-contact member 16 has a first surface 26 with at least one protrusion 28 extending from such surface, as shown in FIGS. 4(*a*)–4(*c*). In a specific version of such embodiment, the shoe 10 has a longitudinal axis A—A, the protrusion(s) 28 are elongated and the ground-contact member 16 is engaged with the head portion 24 in such a manner that the protrusion (s) 28 are oriented so that their elongations 30 are parallel to the longitudinal axis A—A of the shoe 10. Such orientation aids in the side-to-side stability of the shoe 10 during the golf swing. In still another version of the embodiment, each of the protrusions 28 has a first side 32 that is substantially perpendicular to the first surface 26 of the ground-contact member 16 and a second side 34 that forms an acute angle with the first side 26 so that a greater resistance to motion in one direction than the other is provided.

Figure 5A:
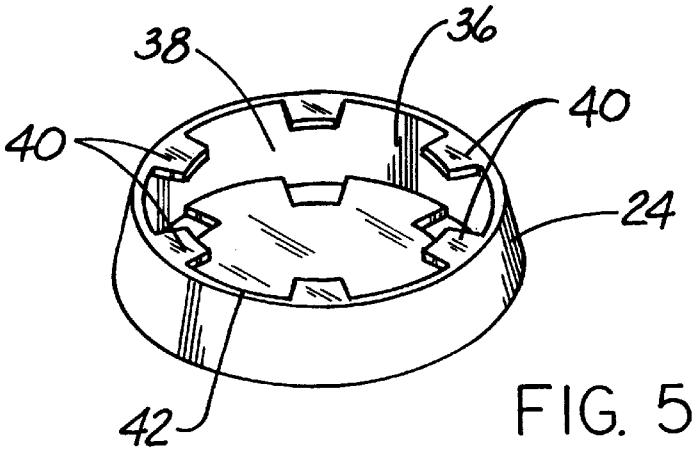
FIG. 5(*a*) is a perspective view of the head portion of the mounting base of the improved cleat structure.
Figure 5B:
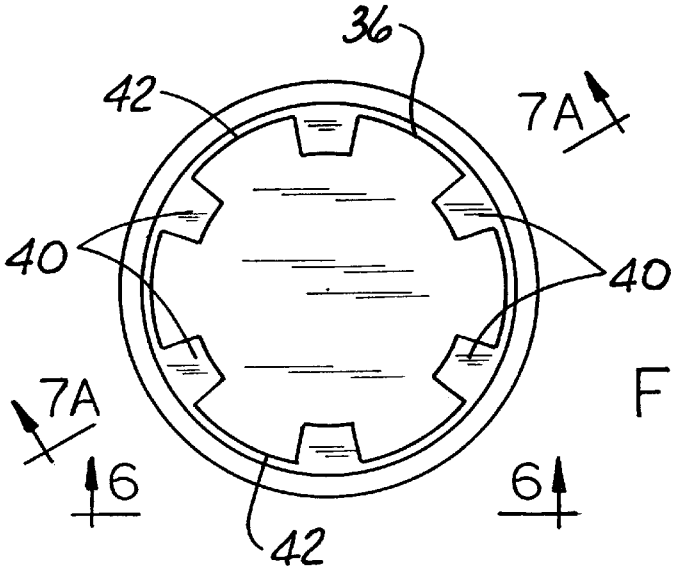

In a more preferred embodiment of the invention, as shown in FIGS. 5(*a*) and 5(*b*), the head portion 24 of the mounting base 20 has an inner edge 36 and a central recess 38. Spaced around the inner edge 36 are a plurality of male segments 40 and intervening female cutaways 42. The ground-contact member 16 in such embodiment, as shown in FIGS. 4(*a*)–4(*c*), is usually made out of some type of plastic although other moldable materials may be used. Such member 16 has an outer edge 44 along which a plurality of fastening segments 46 are positioned. The fastening segments 46 include a cutaway first part 48 that is dimensioned to receive the male segment 40, a recessed second part 50, and a ramped segment 52 that is located between the first part 48 and the second part 50.

The ground-contact member 16 is utilized by placing it in the central recess 38. This is accomplished by dropping the cutaway first part 48 over the male segments 40 spaced around the inner edge 36. Once the ground-contact member 16 is in the central recess 38, it is rotated in such a manner that the male segment 40 slides up the ramped segment 52 into the recessed second part 50 where it is locked into place.

Figure 6:
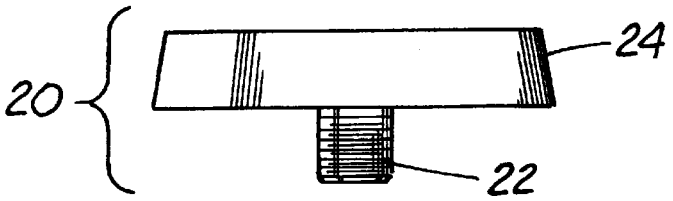
FIG. 6 is a side view of the mounting base of the improved cleat structure.

In a specific version of such preferred embodiment, the connector portion 22 of the mounting base 20 is threaded, as shown in FIG. 6, the sole 14 of the shoe 10 has a plurality of threaded receiving holes 54 and the connector portion 22 of the mounting base 20 is screwed into the receiving hole 54.

In still another version of the preferred embodiment, the ground-contact member 16 has a first surface 26 and at least one protrusion 28 extends from the first surface 26. Such protrusion 28 aids in anchoring the shoe 10 into the ground. In a more specific version, the protrusions 28 are elongated and the shoe 10 has a longitudinal axis A—A. In such specific version, the ground-contact member 16 is engaged with the head portion 24 in such a manner that the protrusion (s) 28 is/are oriented so that their elongations 30 are parallel to the longitudinal axis A—A of the shoe 10. Such orientation aids in preventing the shoe 10 from sliding from side-to-side.

In such specific version, each of the protrusions 28 has a first side 32 that is substantially perpendicular to the first surface 26 of the ground-contact member 16 and a second side 34 that forms an acute angle with the first side 32 whereby a greater resistance to motion in one direction than the other is provided thereby increasing the stability of the shoe 10 as the golfer's weight is shifted from side-to-side during the golf swing.

While the principles of the invention have been shown and described in connection with but a few embodiments, it is to be understood clearly that such embodiments are by way of example and are not limiting.

I claim:

1. In a cleated shoe having a sole and a cleat structure secured thereto, the improvement wherein the cleat structure comprises:

a mounting base having integral connector and head portions, the connector portion being attached to the sole; and a removable ground-contact member engaged with the mounting base head portion and having (a) a substantially flat first surface substantially flush with the head portion and (b) at least one rigid protrusion elongated in direction parallel to the first surface and extending therefrom to a distance less than the length of the elongation, whereby the ground-contact member is engageable with the mounting base to allow selective orientation of the elongation.

2. The cleated shoe of claim 1 wherein:

the head portion of the mounting base includes an inner edge and a central recess, the inner edge having a plurality of male segments and intervening female cutaways spaced therearound; and the ground-contact member has an outer edge having a plurality of fastening segments positioned therealong, the fastening segments including a cutaway first part dimensioned to receive the male segment, a recessed second part, and a ramped segment located between the first part and the second part.

3. The cleat structure of claim 2 wherein:

the connector portion of the mounting base is threaded;

the sole of the shoe has a plurality of threaded receiving holes; and the connector portion of the mounting base is screwed into the receiving hole.

4. The cleat structure of claim 1 wherein:

the shoe has a longitudinal axis; and the ground-contact member is engaged with the head portion in such a manner that the at least one protrusion is oriented so that its elongation is parallel to the longitudinal axis of the shoe.

5. The cleat structure of claim 4 wherein each protrusion is straight and has a first side that is substantially perpendicular to the first surface of the ground-contact member and a second side that forms an acute angle with the first side whereby a greater resistance to motion in one direction than the other is provided.

6. The cleat structure of claim 1 wherein:

the shoe has a longitudinal axis; and the ground-contact member is engaged with the head portion in such a manner that the at least one protrusion is oriented so that its elongation is parallel to the longitudinal axis of the shoe.

7. The cleat structure of claim 6 wherein each protrusion is straight and has a first side that is substantially perpendicular to the first surface of the ground-contact member and a second side that forms an acute angle with the first side whereby a greater resistance to motion in one direction than the other is provided.

* * * * *